US008561240B2

(12) United States Patent
Hui

(10) Patent No.: US 8,561,240 B2
(45) **Date of Patent: *Oct. 22, 2013**

(54) POOL CLEANING VEHICLE WITH ENDLESS LOOP TRACK

(75) Inventor: Wing-kin Hui, Hong Kong (HK)

(73) Assignee: Smartpool LLC, Lakewood, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/531,594

(22) Filed: Jun. 25, 2012

(65) Prior Publication Data

US 2013/0031730 A1 Feb. 7, 2013

Related U.S. Application Data

(63) Continuation of application No. 12/272,730, filed on Nov. 17, 2008, now Pat. No. 8,225,446.

(51) Int. Cl.
*E04H 4/16* (2006.01)

(52) U.S. Cl.
USPC ..... 15/1.7; 180/9.62

(58) Field of Classification Search
USPC ..... 15/1.7; 180/9.62
See application file for complete search history.

(56) References Cited

U.S. PATENT DOCUMENTS

| | | | | | |
|---|---|---|---|---|---|
| 1,292,286 | A * | 1/1919 | Faust | 305/139 |
| 1,673,541 | A * | 6/1928 | Wilson | 180/9.62 |
| 2,467,947 | A * | 4/1949 | Skelton | 180/9.5 |
| 2,941,494 | A * | 6/1960 | McBride | 440/97 |
| 3,900,231 | A * | 8/1975 | Ohm | 305/178 |
| 3,944,006 | A * | 3/1976 | Lassanske | 180/9.62 |
| 4,168,557 | A * | 9/1979 | Rasch et al. | 15/1.7 |
| 5,569,371 | A * | 10/1996 | Perling | 210/85 |
| 6,155,657 | A * | 12/2000 | Erlich et al. | 305/178 |
| 6,968,914 | B2 * | 11/2005 | Tucker | 180/9.62 |

* cited by examiner

*Primary Examiner* — Randall Chin
(74) *Attorney, Agent, or Firm* — Birch, Stewart, Kolasch & Birch, LLP

(57) ABSTRACT

Disclosed herein is a submersible pool cleaning vehicle having an endless loop track. The vehicle including a housing and the housing having members for moving the vehicle around the pool surface. The vehicle including an endless loop track. The track having an exterior and an interior, the interior having a series of ribs and ridges, the ribs having a predetermined width and pitch. The ribs being centrally located on the track while the ridges flank either side of the ribs. The vehicle including drive members for moving the vehicle around the pool surface. The drive members and associated members for moving the vehicle have an exterior surface with a series of grooves and ridges for compatible connection with the ribs. The width of the rib is substantially smaller than the width of the groove and the track ribs engaging the groves.

8 Claims, 4 Drawing Sheets

POOL CLEANING VEHICLE WITH ENDLESS LOOP TRACK

CROSS REFERENCE TO RELATED APPLICATION

This is a continuation application of U.S. application Ser. No. 12/272,730 filed on Nov. 17, 2008, now U.S. Pat. No. 8,225,446 issued on Jul. 24, 2012 and entitled Pool Cleaning Vehicle With Endless Loop Track having the same inventive entity.

FIELD OF THE INVENTION

This invention generally relates to the field of automated pool products. More particularly, this invention relates to a submersible swimming pool vehicle, which includes an endless loop track drive structure for moving the vehicle around the pool surface.

BACKGROUND OF THE INVENTION

It is now well accepted that submersible automated pool cleaning devices, such as self propelled pool cleaning vehicles are essential to the proper maintenance of a pool, whether the pool be above or below ground. The typical vehicle includes a housing and drive members. The drive members attach to the housing usually through connection to a bottom frame. Drive members have, in the past, included wheels driven by a motor stored in the housing. The past vehicle have included two and four wheel drive vehicles. Additionally, past vehicles have included those which are driven by a belt or endless loop track. The track wraps around the drive and/or idler wheels or rollers.

It will be appreciated that a vehicle may also have some combination of wheels and/or rollers and the vehicle may also be a two or four-wheel drive vehicle. The endless loop track may be fitted over any combination of two or four wheel drive vehicles.

Such tracks have been found to be an effective means for moving the vehicle around the surface of the pool while the vehicle is submerged. The track is placed over the drive wheels and/or rollers. In order to move the vehicle, there must be sufficient tension to provide enough torque to move the track through the drive wheels or rollers.

As is well understood, the track is generally flat in cross section. Thus, the challenge for vehicles using such tracks is to hold the track in place without slipping laterally across the track while the vehicle is in motion. Prior vehicles have included a series of alligators across the track. The interior surface of such prior art vehicles includes a series of such alligators which engage the drive wheels for movement of the vehicle.

As with all submersibles, they must operate in a wet environment. Consequently, greater tension is required than in a wet environment. The higher the belt tension, the shorter both the belt life and the motor life.

It is known that by incorporating additional idlers adjacent to the drive wheel additional friction is exerted on the drive wheels and the belt. Thus, the torque is increased as a result of the additional friction. However, the increased torque comes at the expense of increased stress on the drive wheels and the supporting bracket for the drive members. Additionally, the belt still loses traction even with the alligators and additional idler wheels. Thus the original issue remains unresolved.

An additional known advantage of the track is that it overlaps the drive and idlers wheels. Typically, the drive and idlers wheels are made from a high impact and very strong plastic. Without a drive belt, the wheels themselves tend to bump or even crash into the vertical sidewalls of the pool or the pool stairs. Repeated striking of such surfaces can cause damage to not only the vehicle, but to the pool itself. By using a track, the contact between the pool and the vehicle is limited to the track itself. Typically, the track is made from softer material than the hard plastic of the wheels.

What is needed is a submersible automated pool cleaning vehicle which can take advantage of the track drive without suffering losses of torque or early part failure. The submersible vehicle in accordance with this invention provides a track drive which does not create additional tension causing drive members and structures supporting drive members to fail prematurely. Additionally, the submersible vehicle in accordance with this invention provides superior traction capabilities for the vehicle as it travels about the pool surface without damaging the stairs and vertical surfaces of the pool.

SUMMARY OF THE INVENTION

The structure, in accordance with the present invention, is a pool cleaning vehicle having a track drive and means for stabilizing and securing the track to the drive.

It is an object of this invention is to provide a pool cleaning vehicle having a track drive which does not increase tension on the drive members.

It is an additional object of this invention to provide such a pool cleaning vehicle, which has sufficient torque to move around the pool surface using track drive.

It's an additional object of this invention to provide such a pool cleaning vehicle, which uses a track drive and which moves about the pool surface without damaging itself or the pool surface In accordance with the objects set forth above and those that will be described hereinafter, the pool cleaning vehicle in accordance with this invention using a track drive includes a housing and also includes members for moving the vehicle around the pool surface, the vehicle comprising:

an endless loop track, the track having an exterior and an interior, the interior having a series of ribs and ridges, the ribs having a predetermined width and pitch;

drive members for moving the vehicle around the pool surface, the drive members and associated members for moving the vehicle having an exterior surface with a series of grooves and ridges for compatible connection with the ribs; and the width of the rib being substantially smaller than the width of the groove and the track ribs engaging the grooves;

whereby, the track fits loosely with the drive members and associated means for moving the vehicle.

In another exemplary embodiment, the vehicle in accordance with this invention has a track drive, which includes the drive members and associated members for moving the vehicle having a series of ridges with the same pitch as the track ribs.

In another exemplary embodiment, the vehicle in accordance with this invention has a track drive, which includes the track ribs are generally centered and flanked on either side by track ridges.

In another exemplary embodiment, the vehicle in accordance with this invention has a track drive an endless loop track, the track having an exterior and an interior, the interior having a series of ribs and ridges, the ribs having a predetermined width and pitch;

drive members for moving the vehicle around the pool surface, the drive members and associated members for moving the vehicle have an exterior surface with a series of grooves and ridges for compatible connection with the ribs, the grooves having a predetermined width and the width of the ribs being substantially narrower than the width of the grooves; and the track overlapping the drive members and associated members for moving the vehicle such that the grooves and track ribs engaging in a loose fit relationship defining a mismatch fit, whereby, the track fits loosely in the drive members and associated means for moving the vehicle.

It is an advantage of the pool cleaning vehicle in accordance with this invention to be able to move around the surface of the pool without damaging either itself or the pool.

It is an additional advantage of the instant invention to provide such a track drive vehicle, without premature failure of the drive members and associated members of the vehicle.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
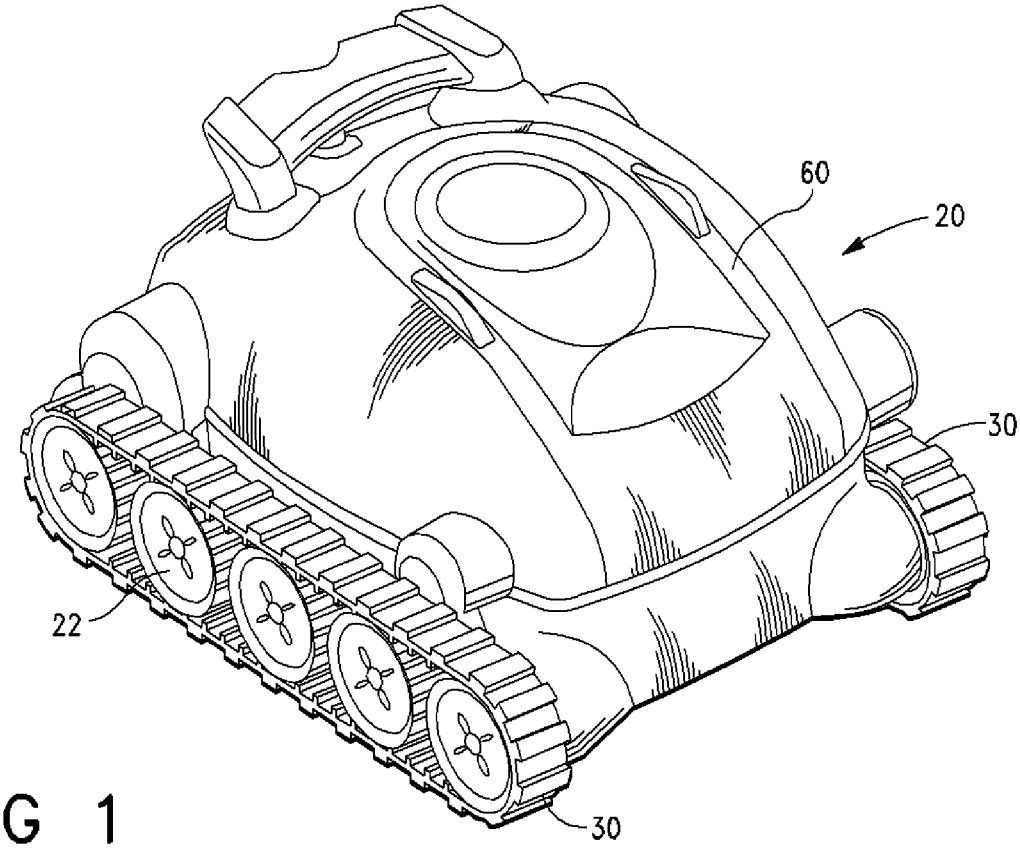
FIG. 1 is a perspective view of the pool cleaning vehicle in accordance with this invention illustrating track drive.

With respect to FIG. 1 there is shown an exemplary embodiment of the submersible pool cleaning vehicle in accordance with this invention generally denoted by the numeral 20. The vehicle 20 includes a housing 60. Attached to the housing 60 are a set of wheels 22. Each side of the vehicle 20 includes such wheels 22. An endless loop drive belt or track 30 overlaps the wheels 22 as seen clearly in the FIGS. 1-6.

Figure 2:
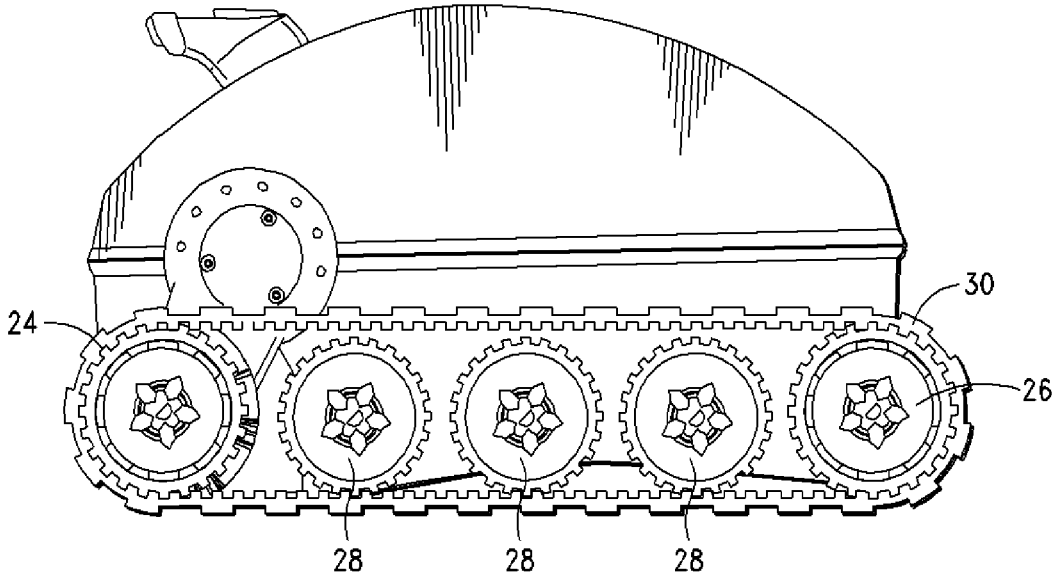
FIG. 2 is side view of an exemplary embodiment of the pool cleaning vehicle in accordance with this invention also illustrating track drive

The vehicle 20 includes a motor, not shown. The motor is connected to one or more drive wheels 24, as shown in FIG. 2. When the motor is activated and engages the drive wheel 24, the drive wheel(s) 24 turn causing movement of the vehicle 20. In the exemplary embodiment shown in FIG. 2, the drive wheel(s) 24 turn engaging the track 30 which then causes movement of the vehicle.

Figure 6:
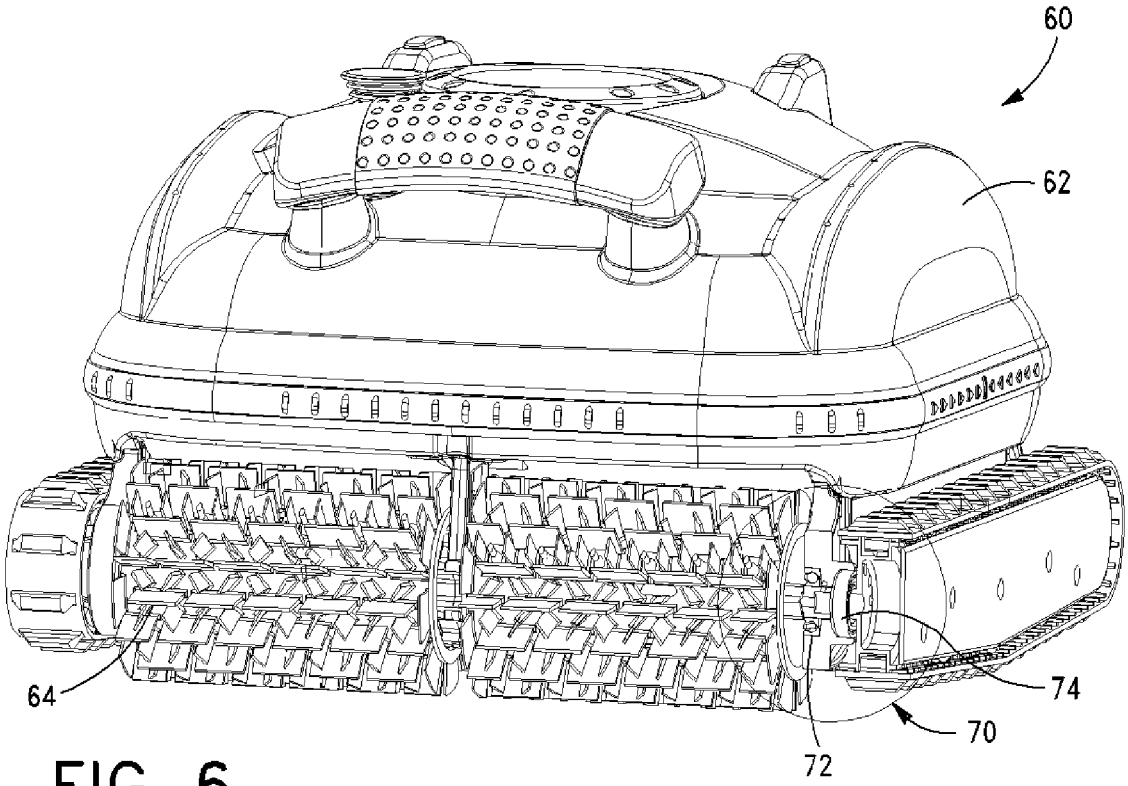
FIG. 6 illustrates a roller drive pool cleaning vehicle having a track drive in accordance with this invention.
Figure 7:
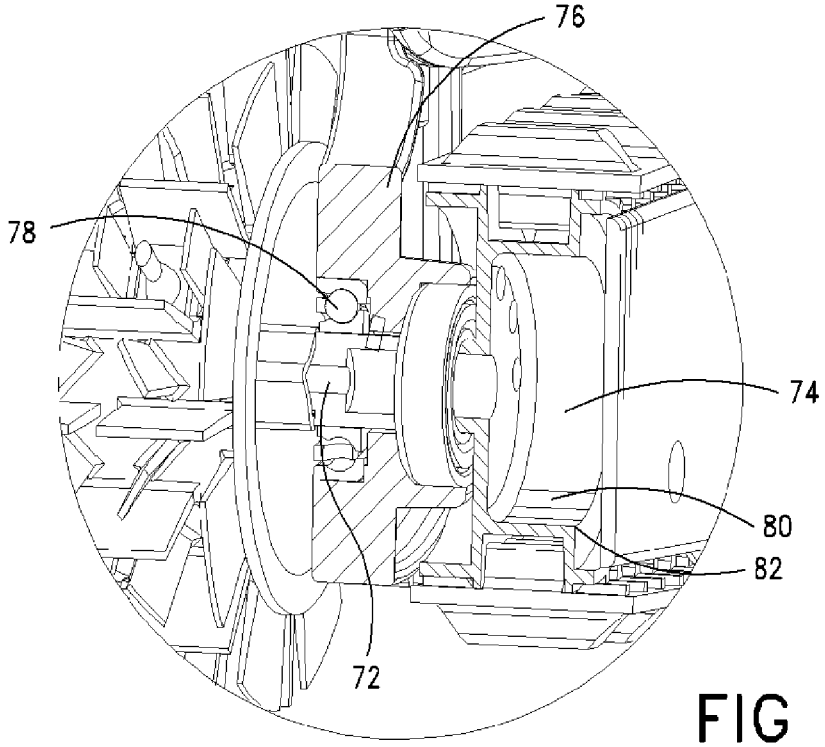
FIG. 7 is an enlarged perspective view of the vehicle of FIG. 6 exploring in detail the circled area of FIG. 6.

As shown in FIG. 2, the drive assembly includes a motor, drive wheel(s) 24, front wheels 26 and a set of idler wheels 28. It will be appreciated that the front and drive wheels could in another exemplary embodiment be rollers as well as wheels and FIGS. 6 & 7 are illustrative of this principle.

Additionally, it will be appreciated that front wheels 26 in another embodiment are drive wheels as well. Either a second motor is added to the vehicle and connected directly to the front wheels for engaging the front wheels as drive wheels or a transmission is added to the original motor for powering and engaging the front wheels 26 making them drive wheels as well. Each of the above embodiments is within the spirit and scope of the invention.

As is known, idler wheels, such as idler wheels 28 increase the ability of the vehicle 20 to provide adequate or even superior torque. The three pair of idler wheels 28 are added for that purpose here.

As seen clearly in FIGS. 2-5, and FIG. 8, the track 30 has an interior surface 32 and an exterior surface 34. The exterior surface 34 must be reasonably pliant to provide traction as the submerged vehicle moves about the pool surface while providing sufficient gripping strength to climb vertical obstacles in the pool. Therefore, not unlike an automobile or other land based vehicles, the exterior surface of the track 30 is provide with a tread suitable for that purpose. This is not unlike the tread an automobile tire, such an SUV tire, has for successfully accomplishing off road travel.

In comparison, the wheels 24, 26 and 28 are made from a hard plastic material capable of withstanding repeated impact from crashing into vertical pool surfaces and even capable of withstanding impact from falling. Such hard plastic would not be suitable for traction and such hard plastic is considerably harder than the material from which the track 30 is made.

Figure 8:
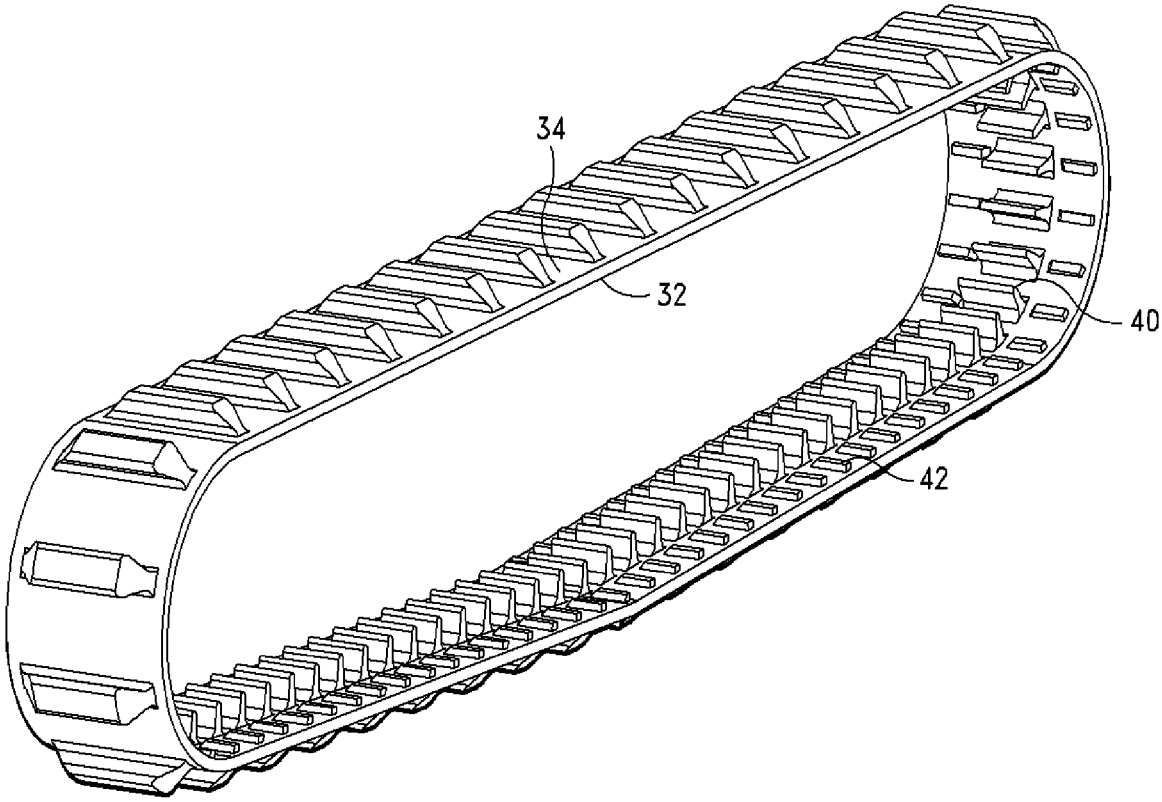
FIG. 8 illustrates an exemplary embodiment of an endless loop track in accordance with this invention.

The interior surface 32 of the track 30 has a series of ribs 40 and ridges 42 as best shown in FIG. 8. The ribs 40 are raised from the interior surface 32 and project into the central portion of the track loop. The ribs are centrally located on the track 30.

The ridges 42 are located on either side of the ribs 40. The ridges 42 provide additional support for the track to prevent sideways slippage.

Each of the ribs 40 and the ridges 42 have a predetermined pitch and width. In the exemplary embodiment of FIG. 8, the ridges 40 and ribs 42 have the same pitch.

As shown in FIGS. 1-3, & FIG. 5, there is a preferred structure for the drive wheel(s) 24. The drive wheel has an exterior surface 25 with a series of grooves 27. The pitch of the drive wheel groove 27 matches the pitch of the ribs 40.

The groove 27 of the drive wheel 24 is formed in sinusoidal fashion. At either end of the groove 27, there is an upstanding wall 29. Adjoining upstanding walls 29 form a groove ridge 31. The width of the groove is defined as the distance between groove ridges 31.

In order to provide a loose fitting match between the drive wheel groove 27 and the track 30, the width of the track ribs 40 is substantially less than the width of the groove 27. In this manner, there is a sloppy match or a mismatch between the wheel grooves and the track ribs. This mismatch causes a loose fit which prevents undue stress on the drive motor, the drive members and other associated wheels and drive elements in the vehicle in accordance with this invention.

Sufficient torque is provided by the engagement of the grooves and ridges. Thus this positive and direct form of engagement between the track and drive wheels enables the vehicle to sustain sufficient to superior torque while maintaining this loose fit.

Figure 3:
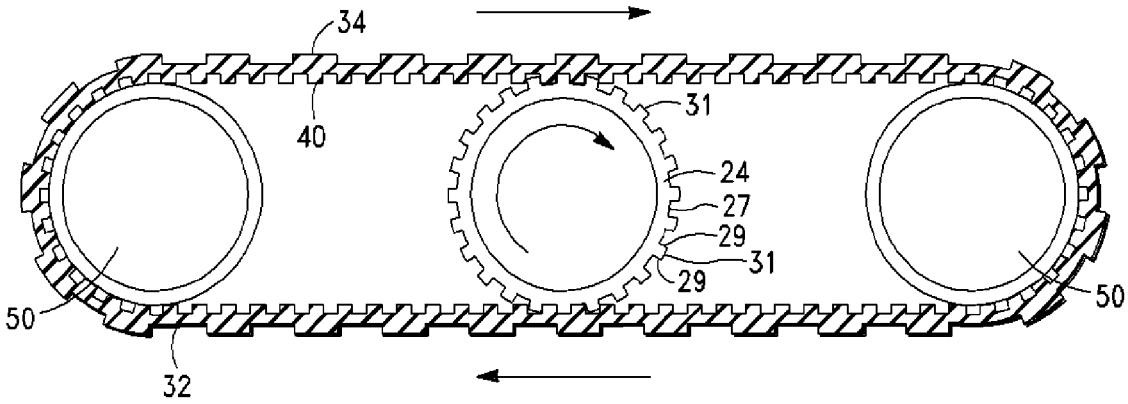
FIGS. 3-5 illustrates various exemplary embodiments of the track drive for the pool cleaning vehicle in accordance with this invention.
Figure 4:
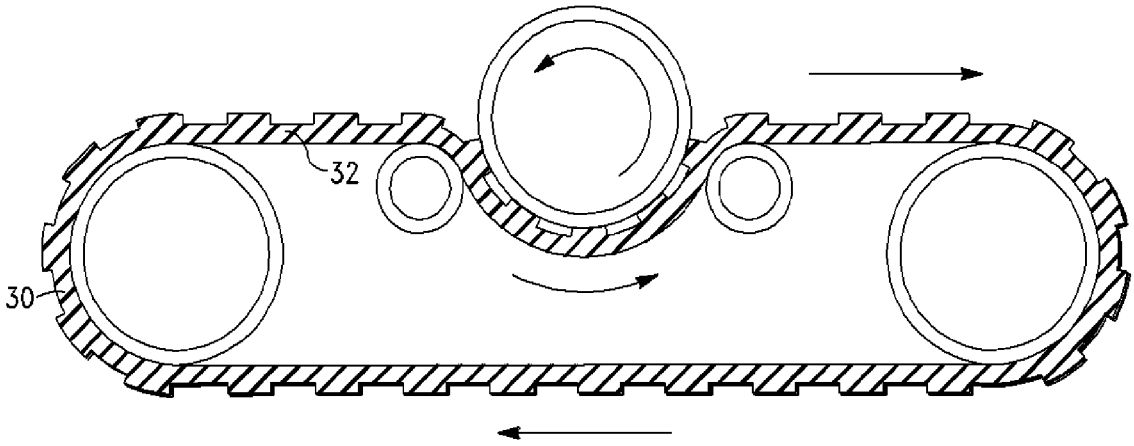

With particular reference to FIG. 3, there is shown the exemplary embodiment of the vehicle 20 wherein the drive wheel(s) are centrally located within the track loop. This embodiment includes associated front and back movement wheels (and/or rollers) 50 to be located at the front and back of the vehicle 20.

Figure 5:
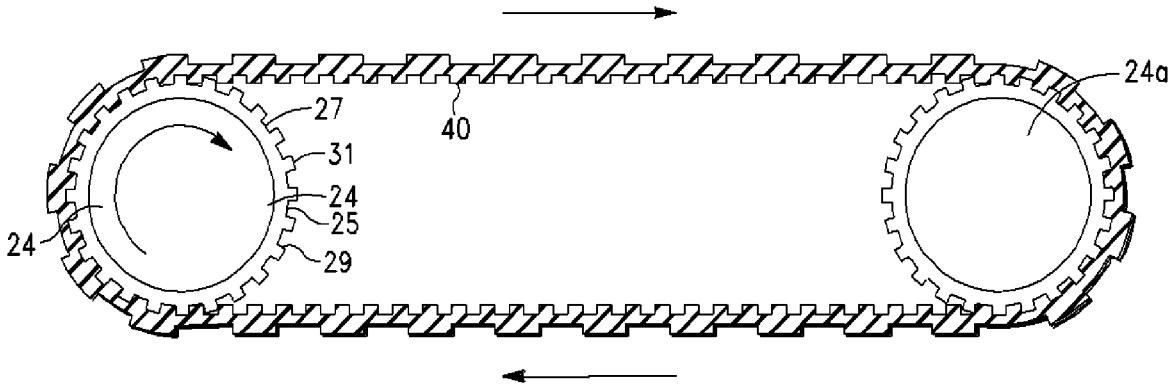

With particular reference to FIG. 5, there is shown the exemplary embodiment having rear wheel drive. The drive wheel(s) 24 is located at the rear of the vehicle as the vehicle moves throughout the surface of the pool. It will be appreciated that this could just as easily be a representation of a front wheel drive vehicle.

In another exemplary embodiment of the vehicle 20 in accordance with this invention, the depiction shown in FIG. 5 is capable of being a four wheel drive vehicle having a second set of drive wheels 24*a*.

With particular reference to FIGS. 6 & 7, there is shown a roller drive embodiment of the submersible track drive vehicle in accordance with this invention, generally designated by the numeral 60. The submersible vehicle 60 includes a housing 62 and a front drive roller assembly 64. The drive assembly 64 is connected to the housing through a drive assembly support, generally designated by the numeral 70.

The drive assembly 64 rotates around a drive axle (not shown). The drive axle has an extension 72. A drive wheel assembly 74 corresponding to the drive wheel 24 of the earlier described embodiments is connected to the extension 72.

The extension 72 extends from the drive axle and is supported on the housing 62 by an extension support bracket 76. The bracket 76 is secured to the housing 62 by means well understood in the art.

The bracket 76 includes a ball bearing assembly 78. The extension 72 rotates freely within the ball bearing assembly 78 transmitting, with efficiency, the torque generated by the drive rollers to the drive wheel assembly 74. It will be appreciated that the ball bearing assembly is replaceable by a journal bearing assembly or similar bearing in another exemplary embodiment of the vehicle in accordance with this invention.

The drive wheel assembly 74 similarly has a series of grooves 80 and ridges 82 to the earlier described drive wheel 24. And, similarly, the ribs of the track match with the drive wheels 74 as described above.

It is clearly seen in the exemplary embodiment described in FIGS. 6 & 7 that the drive wheel assembly 74 is outside the housing 62. It will be appreciated that the drive wheel 74 is mounted in cantilevered fashion from the roller assembly 64. As a result of the support from the extension support bracket 76 and the ball bearing assembly 78, there is sufficient support to mount the drive wheels in such a cantilevered manner. In fact, not only are drive wheels able to be mounted in such a cantilevered manner, but all wheels, front, back and idlers are able to be so mounted. Again, saving additional interior space for the housing.

Also, as seen in FIGS. 6 & 7, the wheel assembly 74 is offset from the housing 62. The track 30 substantially overlaps the drive wheel assembly 74. As noted above the track is made from much softer material than the hard plastic of the drive and associated wheels, which can damage the pool surface as the vehicle contacts the pool surface. On the other hand, the track 30 will be far less likely to damage either itself, the vehicle or the pool surface upon such contact. Additionally, because the track 30 substantially overlaps the drive wheels and is offset from the housing, the track 30 is substantially more likely to make at least first contact with the pool surface.

By using such a cantilevered mounting the drive wheels 74 are outside the housing 62 and the crowded interior of the housing can be made available for other elements of the vehicle or enabling the vehicle 60 to be made smaller.

While the foregoing detailed description has described several embodiments of the pool cleaning vehicle in accordance with this invention, it is to be understood that the above description is illustrative only and not limiting of the disclosed invention. Particularly, there are variety of different combinations of wheels and/or rollers that can be used successfully with the vehicle in accordance with this invention. Each such combination is within the spirit and scope of this invention. It also will be appreciated that there are various modifications to the interior and exterior of the track are also within the spirit and scope of the invention herein and that of particular interest is the ability of the exterior of the track to provide traction against the pool surface during submersible movement of the vehicle and the interior of the track to provide sufficient torque transmission to the track to create such movement. Thus, the invention is to be limited only by the claims as set forth below.

The invention claimed is:

1. A submersible pool cleaning vehicle, the vehicle including a housing and the housing having drive members for moving the vehicle around the pool surface, the vehicle comprising:

an endless loop track, the track having an exterior and an interior, the interior having a series of ribs, the ribs having a predetermined width and pitch;

a combination of drive members and associated members having at least one drive member for moving the vehicle around the pool surface, the drive members and associated members for moving the vehicle have an exterior surface with a series of grooves and ridges for compatible connection with the ribs, the grooves having a predetermined width and the width of the ribs being substantially narrower than the width of the grooves; and the track overlapping the drive members and associated members for moving the vehicle such that the grooves and track ribs engaging in a loose fit relationship defining a mismatch fit, whereby the track fits loosely in the drive members and associated members for moving the vehicle.

2. A submersible pool cleaning vehicle as set forth in claim 1, wherein the interior surface of the track includes ridges flanking the ribs.

3. A submersible pool cleaning vehicle as set forth in claim 1, wherein the ribs are centrally located on the track and wherein the ribs are flanked by a pair of ridges.

4. A submersible pool cleaning vehicle as set forth in claim 1, wherein the ribs and ridges all have the same pitch.

5. A submersible pool cleaning vehicle as set forth in claim 1, wherein the ribs and ridges all have a different pitch.

6. A submersible pool cleaning vehicle, the vehicle including a housing, a motor within the housing powering drive rollers and drive wheels for moving the vehicle around the pool surface, the vehicle comprising:

an endless loop track, the track having an exterior and an interior, the interior having a series of ribs, the ribs having a predetermined width and pitch;

drive rollers for moving the vehicle around the pool surface, the drive rollers rotating around a drive axle and the drive axle having an extension member, drive wheels mounted on the extension member, the drive wheels having an exterior surface with a series of grooves and ridges for compatible connection with the track ribs, the grooves having a predetermined width and the width of the ribs being substantially narrower than the width of the grooves; and the track overlapping at least the drive wheels and rollers for moving the vehicle such that the grooves and track ribs engage in a loose fit relationship defining a mismatch fit, whereby, the track fits loosely in the drive wheels and rollers for moving the vehicle.

7. A submersible pool cleaning vehicle as set forth in claim 6, wherein the wheels are offset and outside of the housing.

8. A submersible pool cleaning vehicle as set forth in claim 6, wherein the wheels are mounted to the housing and/or rollers in a cantilevered manner.

* * * * *